United States Patent [19]

Zimmermann

[11] Patent Number: 4,739,922

[45] Date of Patent: Apr. 26, 1988

[54] DISPENSING CONTAINER

[75] Inventor: John Zimmermann, Scarborough, Canada

[73] Assignee: Somerville Belkin Industries Limited, London, Canada

[21] Appl. No.: 867,699

[22] Filed: May 28, 1986

Related U.S. Application Data

[63] Continuation-in-part of Ser. No. 729,212, May 1, 1985, abandoned.

[51] Int. Cl.[4] ..... B65D 5/36; B65D 5/54

[52] U.S. Cl. ..... 229/122.1; 206/620; 221/305; 229/104; 229/117; 229/150

[58] Field of Search ..... 229/41 R, 41 B, 17 B, 229/104, 117, 121, 122, 150; 221/306, 281, 302, 305, 309; 206/611, 620

[56] References Cited

U.S. PATENT DOCUMENTS

| | | | |
|---|---|---|---|
| 1,915,341 | 6/1933 | Walker et al. | 229/17 B |
| 2,005,924 | 6/1935 | Wilson | 229/17 B |
| 2,385,400 | 9/1945 | Briggs | 229/17 B |
| 2,866,588 | 12/1958 | Bolding | 229/41 B |
| 3,204,762 | 9/1965 | Shanok et al. | 229/17 B |
| 3,301,388 | 1/1967 | Rockwell | 229/17 B |
| 3,309,206 | 3/1967 | Daniels | 229/17 B |
| 3,568,883 | 3/1971 | Reynolds | 221/305 |
| 3,568,911 | 3/1971 | Bebout | 229/17 B |

FOREIGN PATENT DOCUMENTS

| | | | |
|---|---|---|---|
| 873185 | 6/1971 | Canada | 229/17 B |
| 1057262 | 10/1953 | France | 229/17 B |
| 1422197 | 11/1965 | France | 229/17 B |
| 859794 | 1/1961 | United Kingdom | 229/41 B |
| 933333 | 8/1963 | United Kingdom | 229/41 B |

*Primary Examiner*—Stephen Marcus
*Assistant Examiner*—Gary E. Elkins
*Attorney, Agent, or Firm*—Fetherstonhaugh & Co.

[57] ABSTRACT

A cardboard container having a dispensing opening formed in the lower portion of its front wall through which articles can be withdrawn. The container has a bottom wall that is elevated from its lower end. The front portions of the lower edges of the side walls and the lower edge of the front wall overhanging the front edge of the bottom wall, whereby the bottom wall has an area less than the cross-sectional area container space above the bottom wall. When a stack of articles are housed in the container with the lowermost article resting on the bottom wall it will overhang the bottom wall in the area of the dispensing opening and can be manipulated from the underside of its overhanging portion and removed from the container through the dispensing opening from the container.

8 Claims, 10 Drawing Sheets

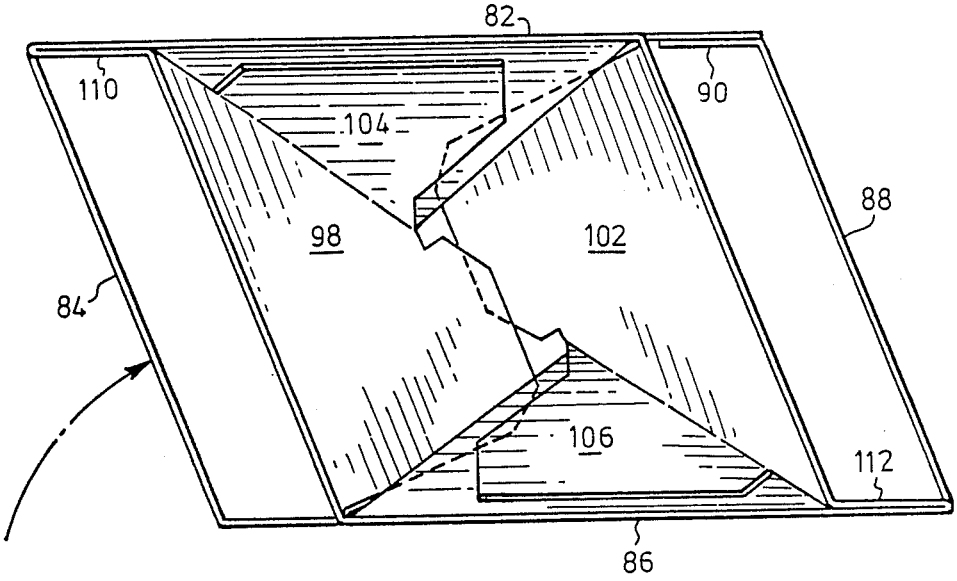
FIG. 13
FIG. 14
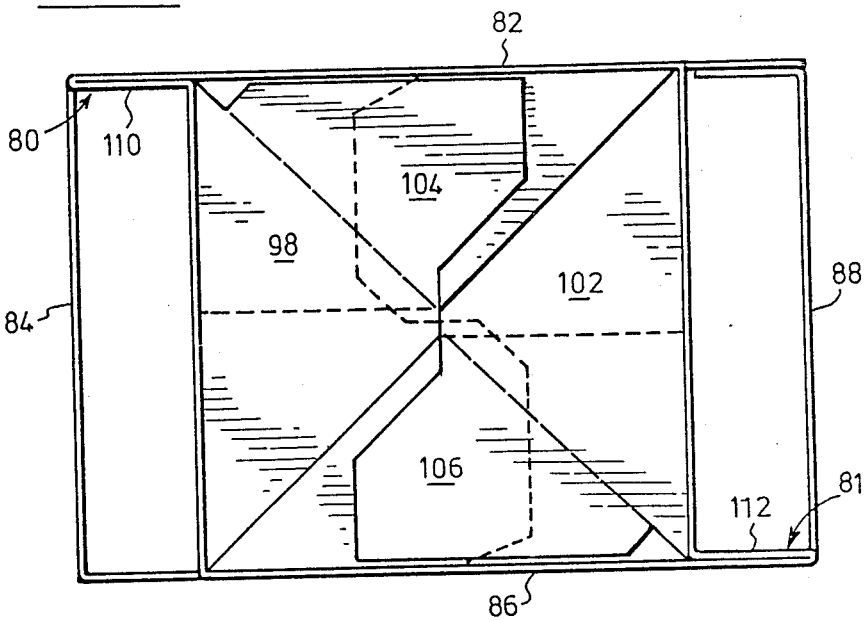

DISPENSING CONTAINER

This application is a continuation-in-part application of application Ser. No. 06/729,212 filed May 1, 1985, now abandoned.

This invention relates to a dispensing container of the type in which packages are stacked and the package resting on the bottom can be withdrawn through an opening at the lower end of a wall of the container.

Dispensing containers of this type are commonly used. Generally, the container is formed with an opening extending along the marginal bottom portion of the front wall and the forward marginal bottom portions of the side walls. The articles are stacked on top of each other within the container so that the lowermost article rests on the bottom. The lowermost article is accessible through the opening and can be gripped by its opposing sides to be pulled forwardly out of the container from off of the bottom. When the lowermost container is removed, the remaining stack of articles falls to the bottom to present the lowermost article for next removal.

To easily pull an article forwardly from the container off of the bottom, one must be able to apply a proper pulling grip. If the dispensing opening did not extend to the side walls of the container, only the front face of the article would be exposed and a suitable grip to pull the article forwardly could not be realized.

This feature of the prior art has presented problems to the retailer using these dispenser containers. These containers should not be placed in side to side relationship on the store shelf. If they are placed side to side, then the consumer is unable to grip the side edges of the lowermost article because adjacent containers prevent access for gripping the opposing sides of the article. Thus, to ensure a good gripping access to the article, the dispensing container should stand alone with free access to the side walls. To the retailer this means that there will be unusable shelf space.

This invention overcomes this problem by providing a dispensing container having an elevated bottom that is recessed from the front wall. This arrangement allows the lowermost article to extend forwardly of the elevated bottom of the dispensing unit so that the consumer can grip the lowermost article from underneath at its exposed marginal portion that overhangs the bottom for the purpose of pulling it forward. As the dispenser's articles can now be removed by pulling the marginal portion that overlies the bottom, there is no longer a requirement to provide access to the opposing sides of the lowermost article. The dispensing containers can be placed in side to side relation with other containers or items without denying the customer proper use of the dispenser.

This invention also provides a container as set out herein that can be set up from a knock-down configuration.

This invention can also provide a container, as set out herein, that has, in its set-up configuration, a removable flap which covers the dispensing opening to keep the stacked articles from slipping out of the dispensing container during shipping.

This invention can also provide a container having an elevated bottom recessed from both the front wall and the back wall. An opening adjacent the recessed bottom may then be provided on both the back wall and the front wall so that the customer can grip the lowermost article at its underside from either the front or the back of the container.

According to one aspect of the present invention, a cardboard container comprises a front wall; a back wall; side walls; a bottom; the front wall, back wall and side walls are adapted to maintain container contents on the bottom in stacked relation in use; the front wall has a lower edge and is formed with a first dispensing opening at its lower edge through which articles in the container can be withdrawn from the bottom of a stack in use; the side walls have lower edges and the bottom is elevated from the lower edges of the side walls a distance greater than the thickness of the fingers of the hand; the front wall has side edges and the side walls have side edges, the side edges of the front wall each communicating with a side edge of one of the side walls; the lower edge of the front wall is forwardly of, and elevated with respect to, the front edge of the bottom to define the depth of the dispensing opening and to provide a front access space underlying a marginal portion of the bottom article of a stack of articles on the bottom in use, the height of the space being related to the elevated position of the bottom as aforesaid; the bottom has a cross sectional area less than the cross sectional area contained by the walls at a location above the bottom so that the lower most article of a stack of articles on the bottom of the container can be freely accessed by the fingers of the hand from the front access space between the bottom and the lower edges of the side walls to engage the lower most article of a stack of articles on the bottom and remove it from the container through the dispensing opening.

Preferably, there is also a removable article-retaining strip which prevents the articles from slipping out of the dispensing opening prior to use of the container for dispensing. The removable article retaining strip can be tearable from the container to provide access to the front edge of the lowermost article stacked on the bottom.

Preferably, the cardboard container can be articulated from a knock-down configuration to a set-up configuration.

The invention will be more readily understood after reference to the following illustrations of preferred embodiments of the invention.

FIG. 1 is a view of a blank from which the embodiment in FIGS. 1 to 6 is formed from.

FIGS. 10, 11, 12 and 13 illustrate successive folds in making the container of FIG. 8; and FIG. 14 is a perspective illustration from the bottom showing the container of FIG. 8 in the process of being set up and the structure of the support feet.

Figure 1:
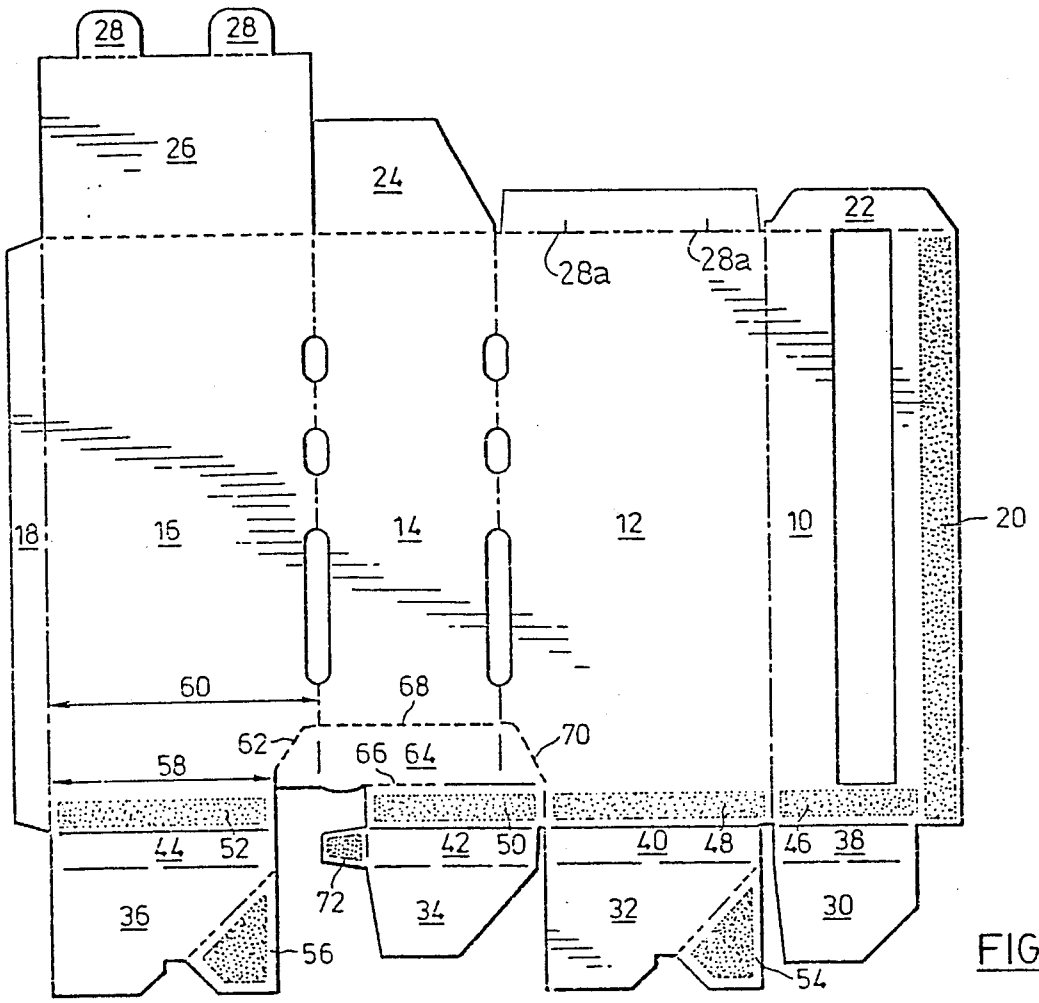
Figure 2:
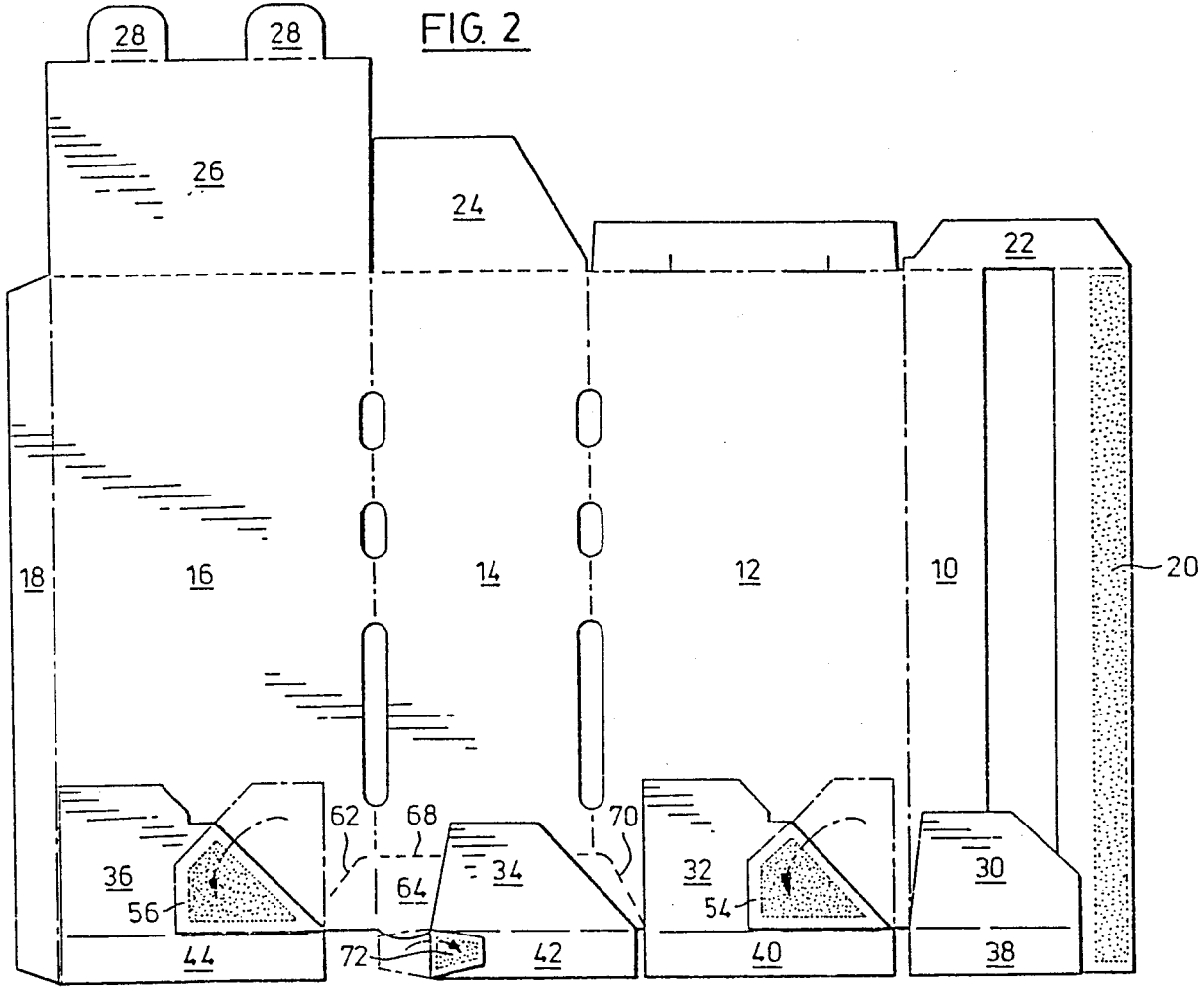
FIG. 2 is an illustration of the initial folds required to assemble the blank into a knock-down container.
Figure 4:
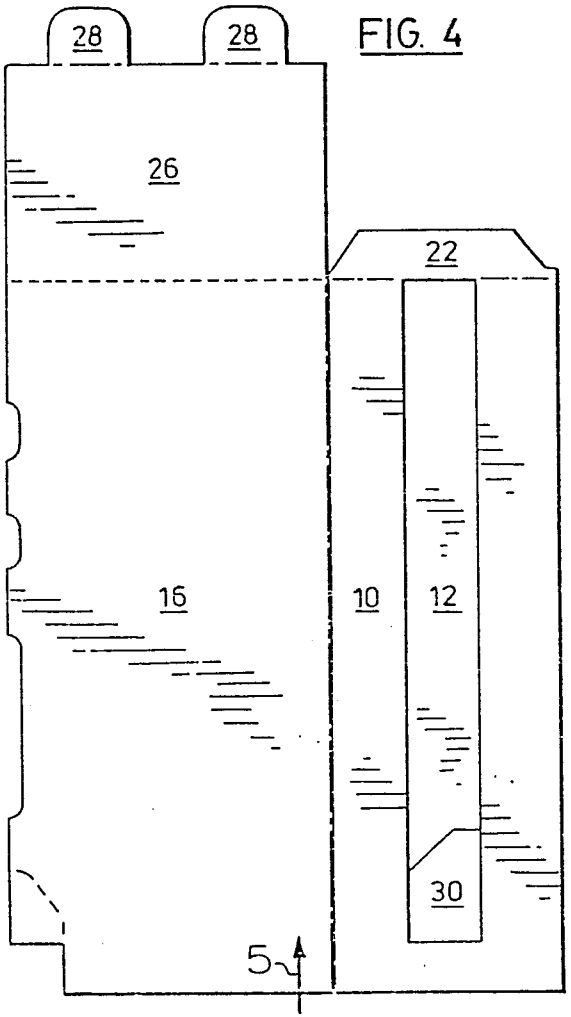
FIG. 4 is an illustration of the container in a lay-flat position.
Figure 3:
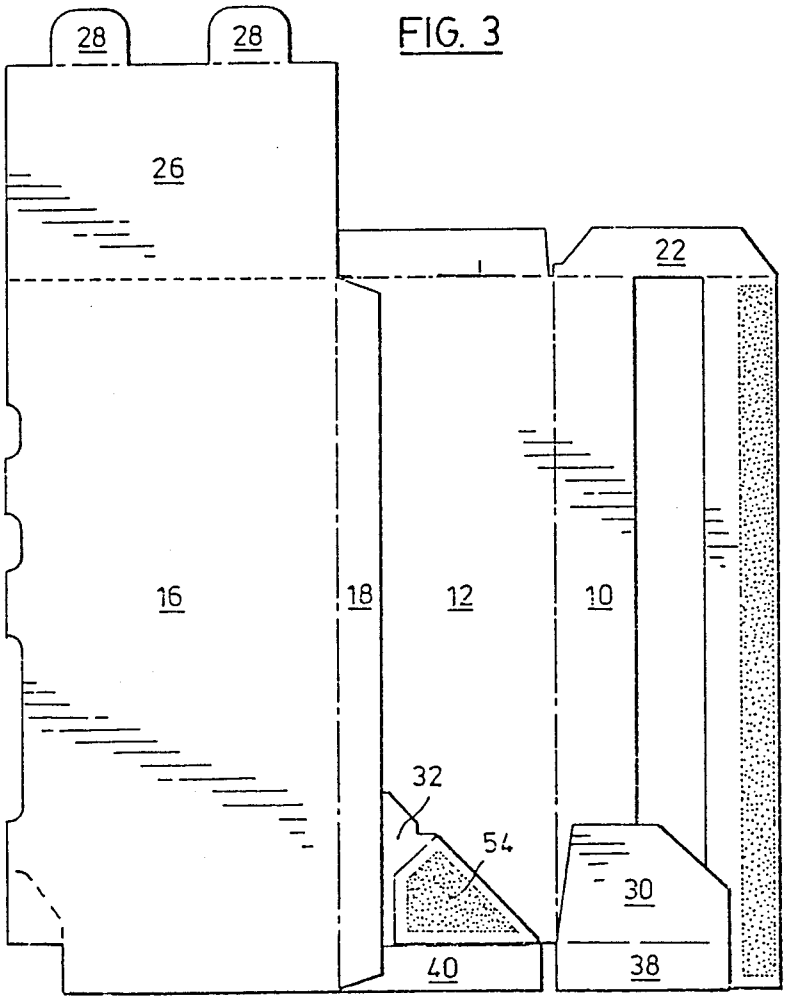
FIG. 3 is an illustration of further folds required to assemble the blank into a knock-down container.

Referring to the drawings, the blank illustrated in FIG. 1 is made from cardboard. The back wall 10, side wall 12, front wall 14, side wall 16 and flap 18 are in serial arrangement and connected by fold lines. In the assembled container, the flap 18 is glued to the glue area marked 20 of the back wall 10. Side wall 16 is similar to side wall 12. The bottom edges 62 and 70 of the side walls incline downwardly and away from the front wall 14. Thus, the width of the side walls at the level where the elevated bottom is to be formed, which is equal to the dimension indicated on side wall 16 by the number 58, is less than the width equal to the dimension, indicated by the number 60, of the side wall at a level above the removable article-retaining strip 64. When the box is assembled in its upright position, the bottom will thus be recessed from the front wall 14 as will be apparent later.

The bottom is formed from flaps 30, 32, 34 and 36. These flaps are each hinged to bottom elevating flaps 38, 40, 42 and 44. In use, as will be explained, the bottom elevating flaps are glued to their respective wall and lie in juxtaposed relation to their respective wall so that the bottom of the container is raised above the bottom edge of the side walls. Numerals 46, 48, 50 and 52 indicate glue areas for securing the bottom elevating flaps to their respective walls.

The raised bottom of the set up box will provide the user with access to the underside of the lowermost article which overhangs the front edge of the bottom.

In the embodiment illustrated, the bottom is of an articulated construction and, in this respect, flap 30 is joined to flap 32 by means of an articulating flap 54. Flap 36 is joined to flap 34 by means of an articulating flap 56. These articulating flaps 54 and 56 have been shown in the illustrations as having an adhesive surface thereon. Tab 72 is hinged to the elevating flap 42 and in use is adhesively secured to the elevating flap 44 to rigidify the recessed bottom of the assembled container as will be apparent later. No patentable novelty is claimed in the mere concept of an articulating bottom and the articulation of the illustrated bottom by means of flaps 54 and 56 is not of itself new.

A removable strip 64 is connected to the front wall 14 by a weakened perforated connection and defined by a transverse line across the front wall 66 at the height of the elevating flaps, a transverse line across the front wall 68 at a distance above the elevator flaps and the inclined lines 62 and its counterpart 70 on the side wall 12 is provided.

However, when container is set up, the removable strip 64 separates along perforated line 66 from the portion of the front wall located below the level of the articulated bottom. In most cases it will require manual manipulation to separate the strip. It will be noted that, in the embodiment illustrated that the free lower edge of the removable strip 64 adjacent the perforated line 66 extends outward below the level of the perforated line 66 to further facilitate the separation of the bottom edge of the strip from the portion of the front wall being below the articulated bottom. The projection of the perforated line 66 as indicated by the solid line is cut.

Figure 5:
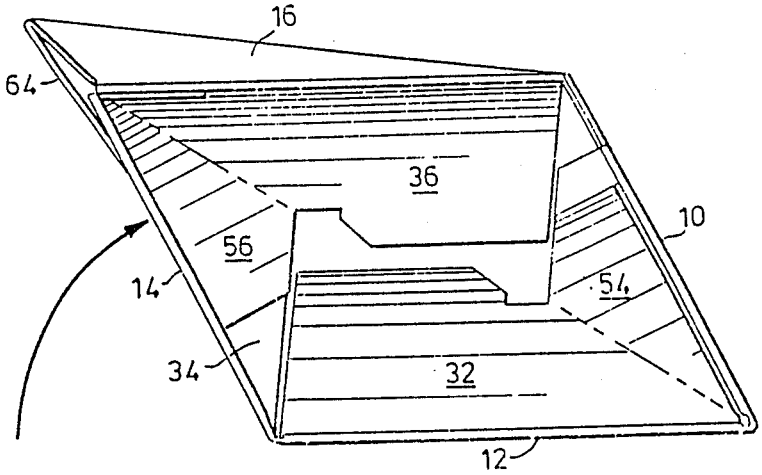
FIG. 5 is an illustration showing the bottom of the container as the container is being actuated from the knock-down to the set up position.
Figure 6:
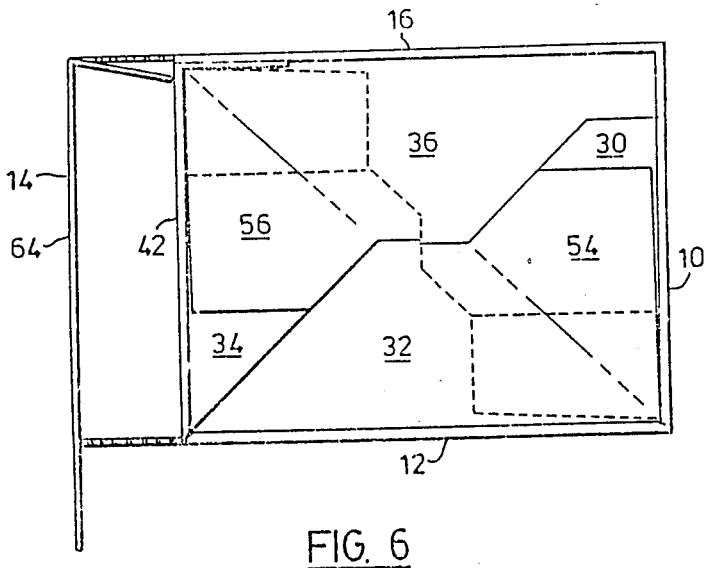
FIG. 6 is an illustration showing the bottom of the container when the container is in the set-up position.

FIG. 5 shows a view from the bottom of the container as initial container set-up stress is being applied by applying pressure to the edges of the container.

When the box is in the set-up configuration, the bottom edge of the removable retaining strip will be positioned forwardly of the portion of the portion of the front wall 14 that is below the front edge of the bottom. The removable retaining strip is still attached by the weakened connections 68, 62 and 70 to the upper portion of the front wall 14 and the downwardly extending edges 62 and 70 of the side walls. It is not essential that the removable retaining strip 64 extend to the side walls. If the removable retaining strip extended only along the bottom marginal portion of the upper front wall, there would still be access to the bottom of the lowermost article a stack of articles in the container in use as will be apparent later.

In the embodiment shown in FIGS. 1 to 6, there is provided a top flap 26 joined by a fold line from side wall 16. There is also provided a top flap 24 joined by a fold line from front wall 14 and a top flap 22 joined to the back wall 10 by a fold line. Side wall 12 also has a top flap. When the container is assembled from the knock-down position to the set-up position top flaps 24, 22 and the top flap attached to the side wall 12 are folded inwardly. Top flap 26 is then folded to lie over these top flaps and tabs 28 are inserted into slots 28(*a*) extending along the fold line at the top of side wall 12.

These types of container tops are old and there is no invention claimed in this respect.

The container, in the set-up position may be sent to the retailer with articles stacked therein and with the removable strip still attached along the weakened connections adjacent the edges 62, 68, 70. It is shipped with the articles stacked in the container. The removable retaining strip 64 prevents the articles from falling out of the dispensing opening during shipping. The stacked articles are indicated in broken lines in FIG. 7 by the numeral 65.

Figure 7:
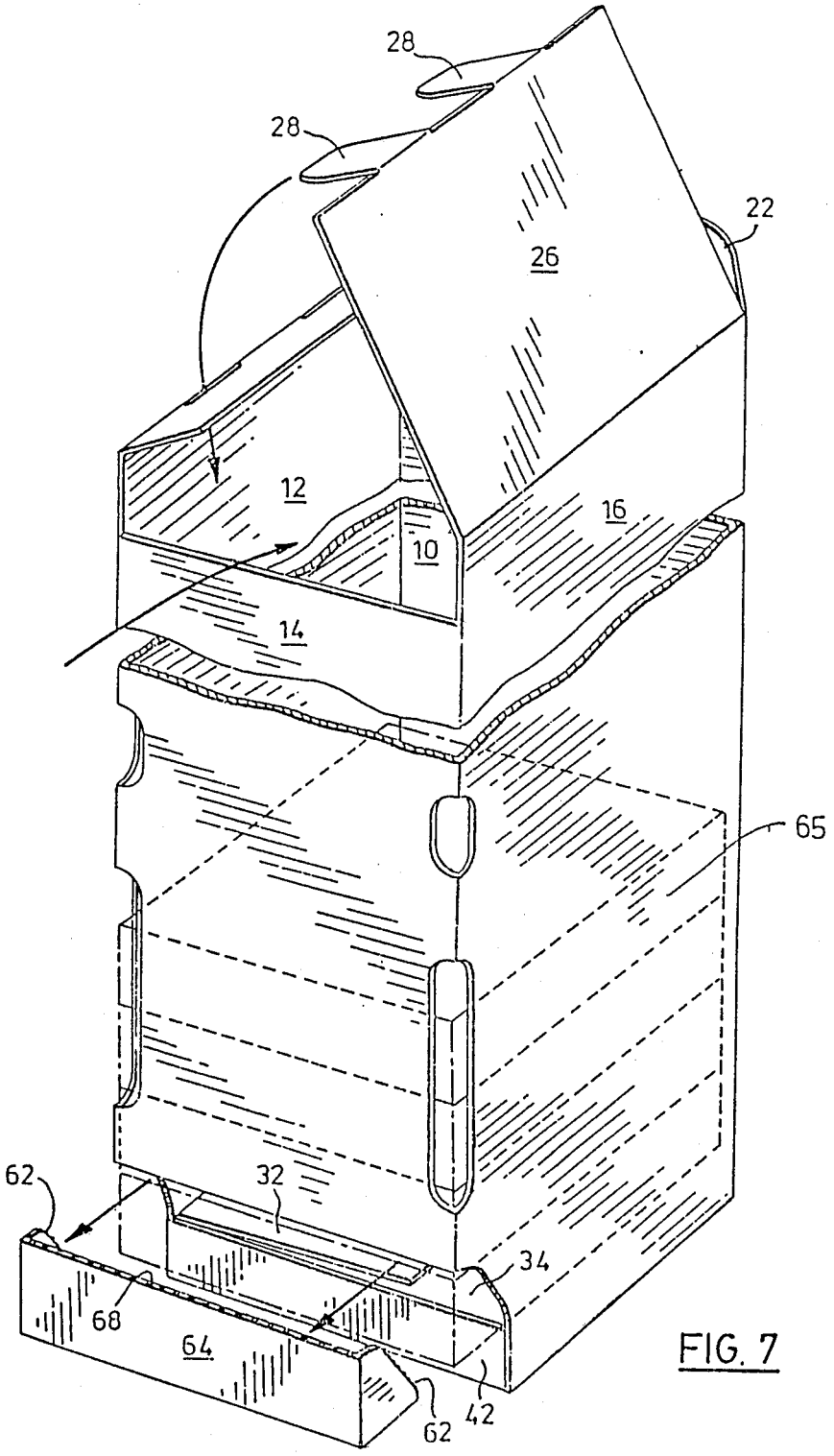
FIG. 7 is a perspective view showing a further embodiment of the container in the set-up position.

In use on the store shelf, the removable retaining strip 64 is removed from the container as shown in the further embodiment of FIG. 7. As explained above, the removable retaining strip is removed along the weakened connections adjacent its edges 62, 68, 70 to provide a dispensing opening in the bottom of the container. When the removable retaining strip has been removed, the lowermost article which sits on the elevated bottom wall may be pulled forwardly by pulling the article at the portion of its underside which overhangs the elevated bottom of the container. The bottom is elevated above the lower edge of the side walls a distance greater than the thickness of the fingers of the hand so that there is finger access to the bottom article when the container sits on a flat surface.

Other retaining means may be used to prevent slippage of the articles out of the dispensing opening during shipping. For example, a removable tape strip or cellophane wrapping may be used.

The embodiment shown in FIG. 7 differs from the embodiment shown in FIGS. 1 to 6 in that there is provided a re-insertion slot in the marginal upper portion of the front wall so that removed articles may be re-inserted into the container. This slot may also be used to replenish the supply of articles in the container.

In the embodiment shown in FIGS. 1 to 6 viewing means are provided in the form of elongated slot extending along the back wall, and a series of smaller elongated slots extending intermittently along the corners formed between the front wall 14 and the side walls 12 and 16. In the embodiment shown in FIG. 7, the viewing means are in the form of elongated slots extending intermittently along the corners formed between the front wall 14 and the side walls 12 and 16. These viewing means allow a person to appreciate how full the container is so that articles can be inserted or a new container placed on the shelf.

This invention provides a container having a dispensing opening adjacent its bottom that has an elevated bottom rearwardly displaced from the front wall of the container. This form of rearward displacement allows for the lowermost article of the stack to overhang the bottom so that a grip to the underside of the article can be realized. By means of this expedient it is possible to mount the containers in side by side relation and still achieve convenient access to slide the article off of the bottom of the container.

Figure 8:
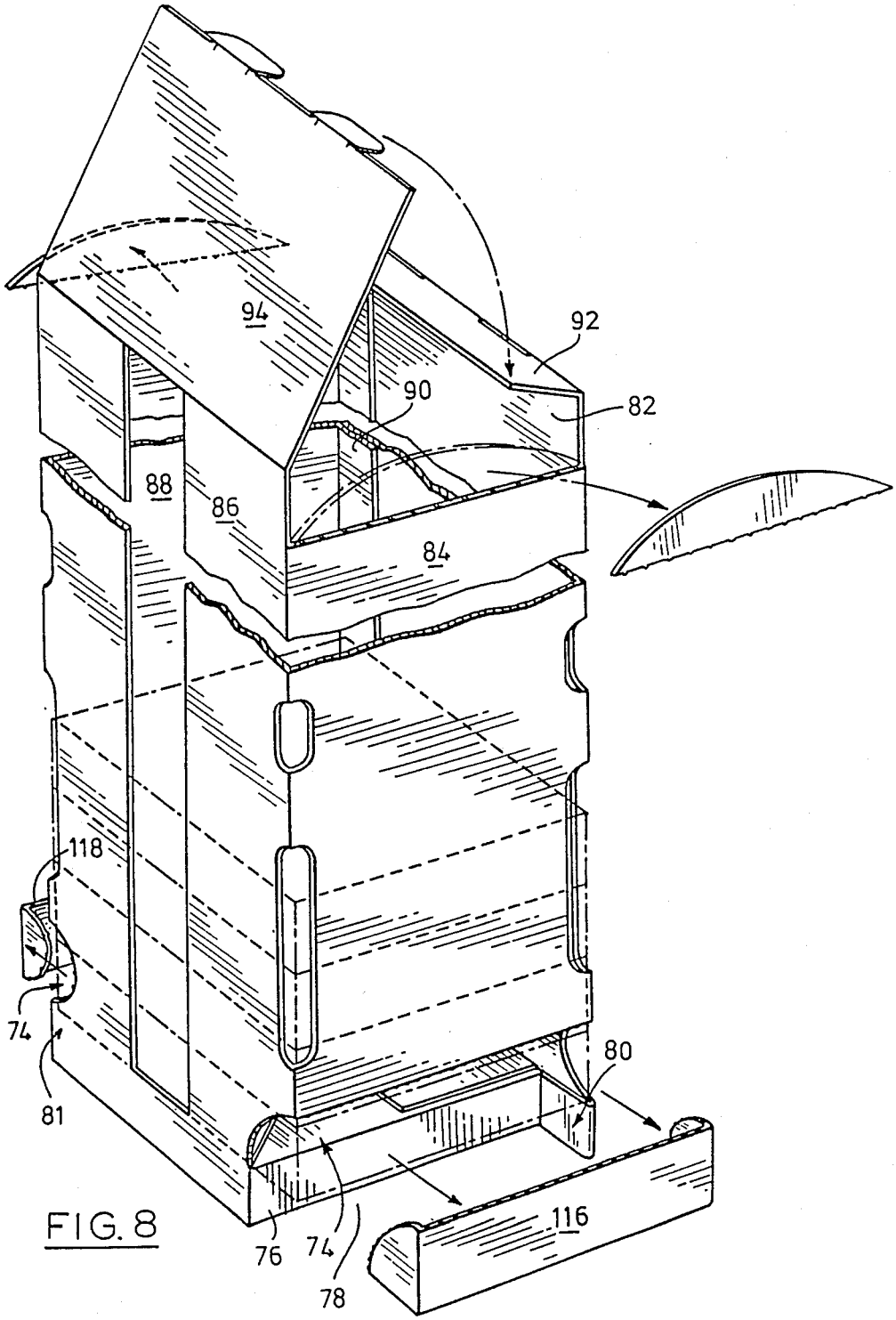
FIG. 8 is a perspective illustration from the front of a further modification of the invention with the article removing strip removed and shows a forwardly extending stabilizing foot; a similar illustration from the back of this embodiment is the same in detail, i.e. the container has two dispensing openings, one on the front wall and the other on the back wall.

The embodiment of the invention shown in FIG. 8 and following has a dispensing opening both in the back and the front of the container.

FIG. 8 is a perspective illustration of a further embodiment of the invention from the front of the container with the article retaining strip removed. It shows a front article dispensing opening 74, the upper extent of which is defined by the lower edge of the front wall which is forwardly of, and elevated with respect to, the front edge of the composite bottom generally indicated by the numeral 76. The forward and elevated characteristic of the lower edge of the front wall with respect to the front edge of the bottom as before defines the depth of the dispensing opening 74 and the front access space 78 which underlies the marginal portion of the bottom article of a stack of articles on the bottom 76 of the container in use. The bottom 76 is elevated a distance greater than the thickness of the fingers of the hand from the lower edges of the side walls so that a person can insert one's fingers in to the space underlying an article that projects through the front dispensing opening and manipulate it in a forward direction out of the container.

The back wall of the container of FIG. 8 is the same in design as the front wall and is provided with an elevated dispensing opening similar to the opening 74. The similarity can be derived from the illustration of the blank from which the container is formed and a perspective illustration from the back is not included in the drawings because it would be the same as the perspective illustration of FIG. 8.

It will be noted that the container has a forwardly extending stabilizing foot 80 that extends from one of the side walls. This foot is of advantage when the container is set upon a flat surface because it gives stability to the container in use. A similar foot is included on the back face.

The container that is able to dispense from both sides is of special advantage where it is desired to print the container with display material in more than one language. Many vicinities require that product labeling be printed in more than one language. If a dispensing side of the container can be formed both on the back and on the front, then it is possible to print one of the languages on the back and the other on the front and, at the time of use, display whichever language is desired.

Figure 9:
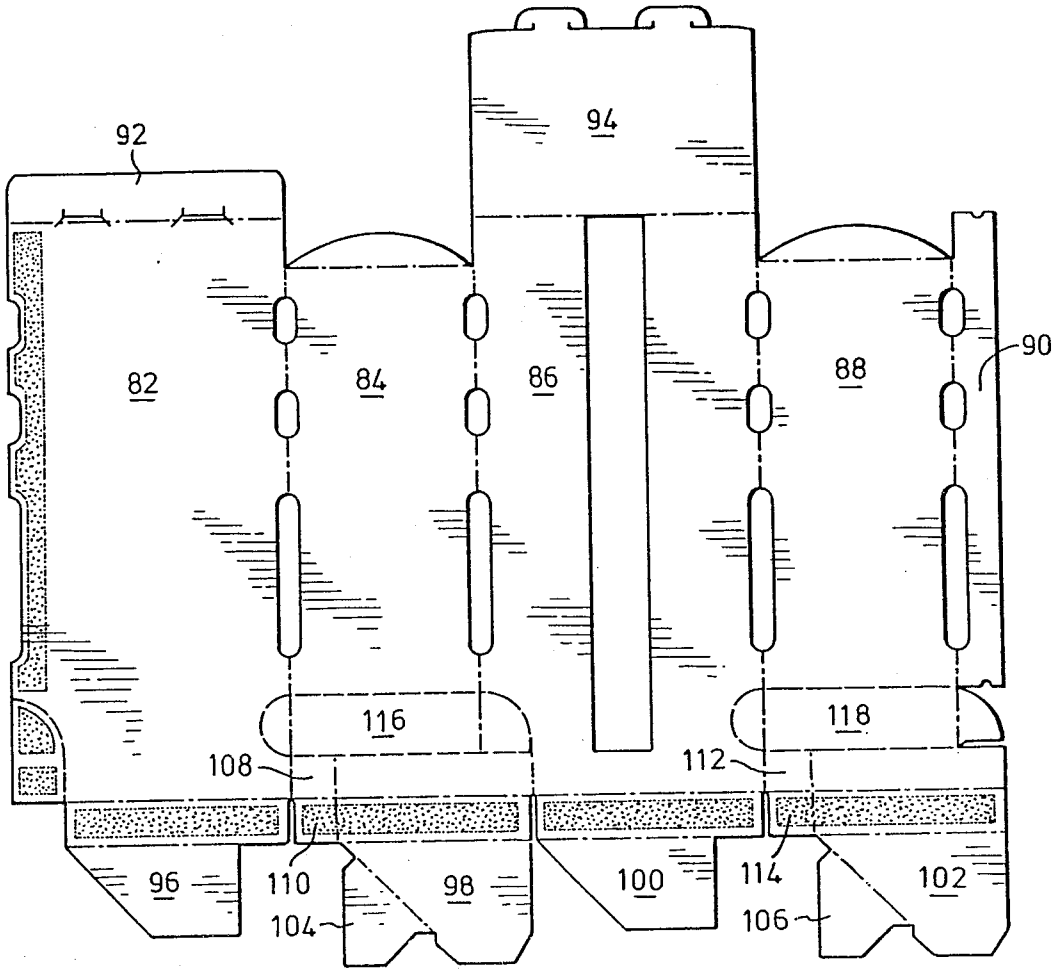
FIG. 9 is an illustration of the blank from which the container of FIG. 8 is constructed.
Figure 10:
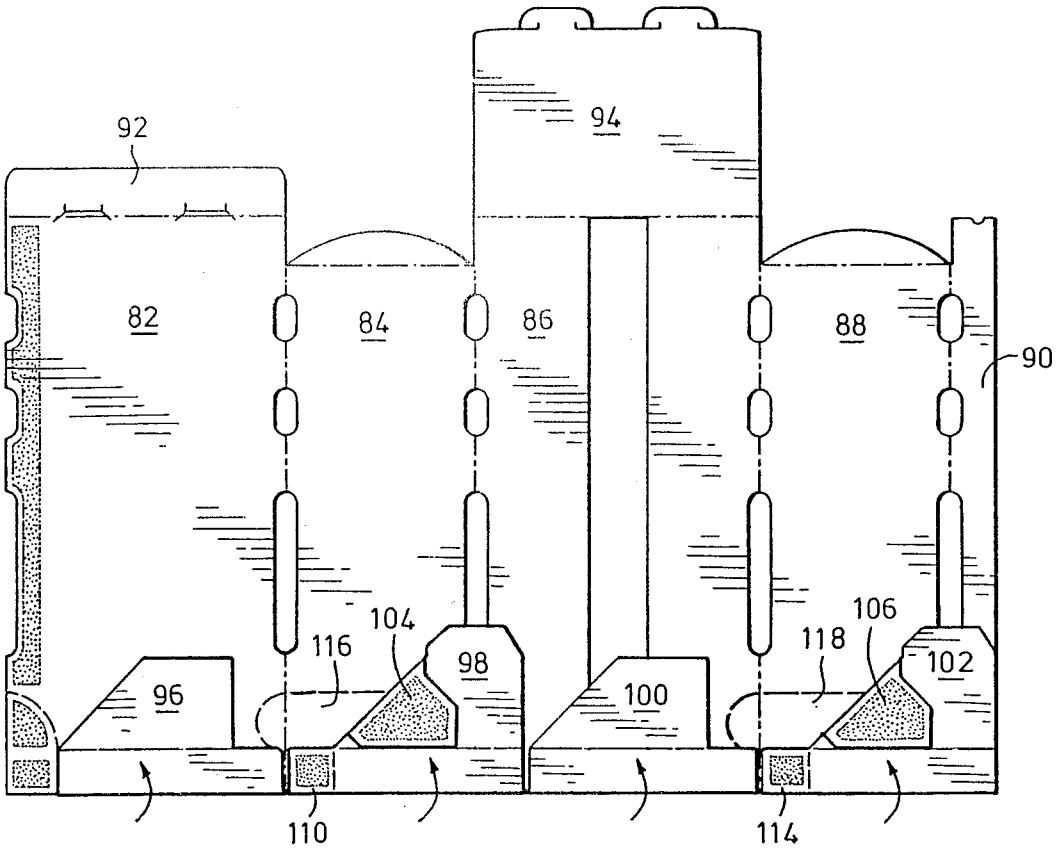

FIG. 9 is an illustration of the blank from which the container is formed. It includes a side panel 82, a back panel 84, a side panel 86, a front panel 88 and a glue strip 90.

The foldable top covers are indicated by the numerals 92 and 94.

The bottom is composed of flaps 96, 98, 100 and 102. Each of which is hinged to a wall panel.

The blank has glue areas on its upper face as illustrated in FIG. 9, as indicated by the stippled areas.

Numerals 104 and 106 are tabs foldably connected to bottom panels 98 and 102 respectively which are glued to become adhesively secured to bottom panels 96 and 100 respectively and function to articulate the bottom to a set up position as the container is moved from the knock down to the set up position. The construction of the articulated bottom is not a part of this invention. It is well known and not referred to in great detail in the specification.

Numerals 108 and 110 are panels that become laminated together and in turn become laminated to the lower portion of side wall 82 to form the foot support 80 on the front wall of the container. Similarily, panels 112 and 114 become laminated together and in turn become laminated to the lower portion of side panel 86 to form the foot support 81 (FIG. 8).

A consideration of the steps illustrated in setting up the container will explain the construction.

The particular manner of achieving the elevated base and the forwardly extending foot support are not of particular significance. One method has been illustrated but it would be apparent that many constructions could be used. It is the concept of the elevated base that is recessed from the front wall to provide access for the fingers underneath the marginal portions of a projecting article on the bottom of a stack and the forwardly extending support foot that is of significance. The manner of achieving it with folds is not considered to be the inventive concept. As indicated, one method is shown but there are alternatives within the scope of the invention.

Numerals 112 and 114 indicate the panels that form the support foot for the back wall of the container.

Numerals 116 and 118 refer to the removable article retaining strips that extend over the front of the dispensing openings until removed.

To form a container the bottom articulating strips 104 and 106 are bent downwardly to overlie the underside of their respective bottom flaps 98 and 102 following which each of the bottom flaps 96, 98, 100 and 102 are folded about their hinge lines to overlie their respective wall panels. In this position adhesive is applied to the articulating flaps 104 and 106 and the support foot flaps 110 and 114.

Figure 12:
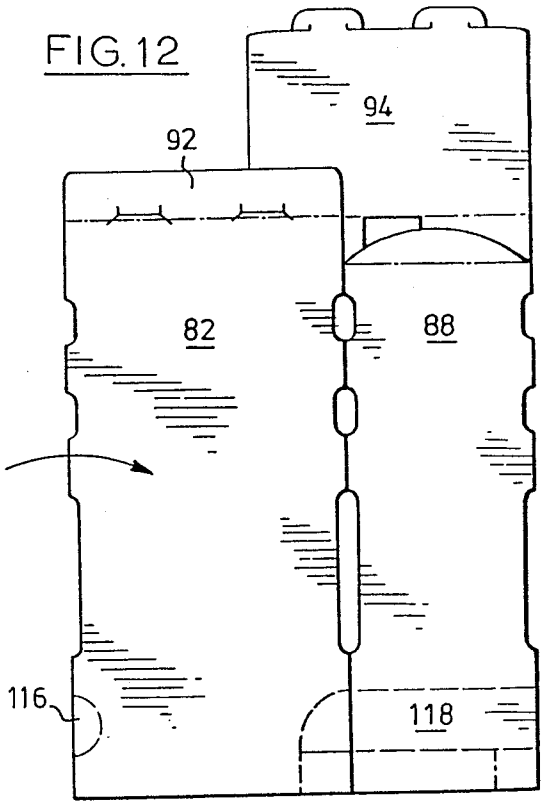
Figure 11:
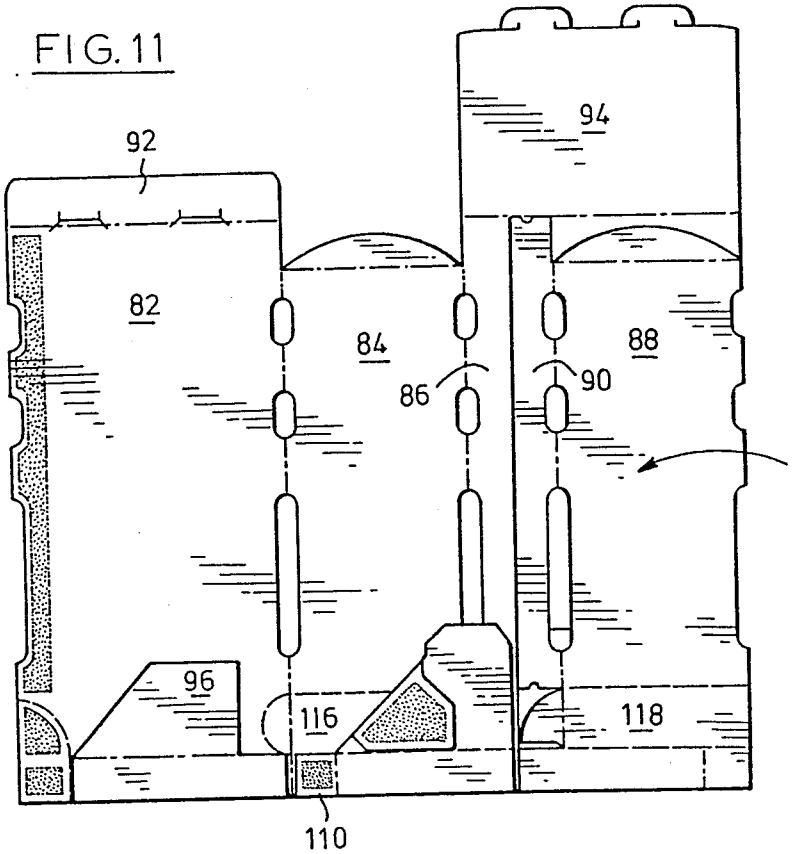

This adhesive being applied, the container is then folded about the fold line between wall panels 86 and 88 as shown in FIG. 11. Following this the panel 82 is folded about its hinge line with panel 84 and the adhesive on the panel 84 joins with the flap 90 to form the container in sleeve form as shown in FIG. 12.

The container is shipped in this form. At the point of use the knock down container is assembled to tubular form. As it is so assembled, the bottom is articulated into its position and the support feet extend forwardly of the bottom as illustrated in FIG. 8.

The embodiment of FIG. 8 has all of the advantages of the previous embodiments plus the advantage of giving the user the choice of dispensing from either side. This is a substantial advantage where one desires to display alternate messages on the container.

The container also has support feet which are of special significance where display is carried on both sides because display on both sides means a reduction in the depth of the base both at the front wall and at the back wall. This reduces the area of the base and the support feet are of a significant assistance.

The container of FIG. 8 and following, as well as the container of FIGS. 1 to 7, has the advantage of permitting the user to dispense articles from a series of containers which are stacked side to side on a shelf or display area.

Other embodiments within the scope of this invention will be apparent to those skilled in the art and it is not intended that the scope of protection afforded be restricted to only those embodiments illustrated but extend to the invention as a whole.

What I claim as my invention is:

1. A cardboard container comprising a front wall;
a back wall;
side walls;
a bottom wall having a front edge;
said front wall, back wall and side walls being adapted to maintain container contents on the bottom wall in stacked relation in use;
said front wall having a lower edge and being formed with a first dispensing opening at its lower edge through which articles in the container can be withdrawn from the bottom of a stack in use;
said side walls having lower edges and said bottom wall being elevated from the lower edges of said side walls a distance sufficient to provide access to the underside of an article resting on said bottom wall in use;
said front wall having side edges and said side walls having side edges, side edges of said front wall each communicating with a side edge of one of said side walls;
the lower edge of said front wall being forwardly of, and elevated with respect to, the front edge of said bottom to define the depth of said dispensing opening and to provide a front access space underlying a marginal portion of an article which rests on the bottom wall in use, the height of the front access space being related to the elevated position of said bottom wall as aforesaid;
said bottom wall having an area less than the cross sectional area contained by said walls at a location above said bottom so that an article which rests on the bottom wall of said container in use can be manually engaged to be removed from the container through said first dispensing opening.

2. A cardboard container as claimed in claim 1 wherein;
said bottom wall has a back edge;
said back wall has a lower edge and is formed with a second dispensing opening at its lower edge through which articles in the container can be withdrawn from the bottom wall of a stack in use;
said back wall having side edges, the side edges of said back wall each communicating with a side edge of one of said side walls;
the lower edge of said back wall being rearwardly of, and elevated with respect to, the back edge of said bottom wall to define the depth of said second dispensing opening and provide a back access space underlying a marginal portion of an article resting on said bottom wall in use; the height of said back access space being related to the elevated position of said bottom wall as aforesaid whereby an article resting on said bottom wall of said container can be freely accessed for manual removal through said second dispensing opening.

3. A cardboard container as claimed in claim 1 wherein a stabilizing foot is fromed on one of said side walls below the level of the bottom wall, said stabilizing foot extending forwardly of the front edge of the bottom wall at said front access space to stabilize the container in use.

4. A carboard container as claimed in claim 2, wherein a stabilizing foot is formed on one of said side walls below the level of the bottom wall, said stabilizing foot extending forwardly of the front edge of the bottom wall at said front access space to stabilize the container is use.

5. A carboard container as claimed in claim 2 wherein a stabilizing foot is formed on one of said side walls below the level of the bottom wall, said stabilizing foot extending forwardly of the front edge of the bottom wall at said front access space to stabilize the container in use.

6. A cardboard container as claimed in claim 1 further comprising;
a removable article retaining strip attached by a weakened connection to the said front wall;
said removable article retaining strip, serving to prevent the passage of articles through the said first dispensing opening;
said removable article retaining strip being tearable from the container to open said first dispensing opening to permit the removal of articles from said container through said first access passage.

7. A carboard container as claimed in claim 2 further comprising;
a removable article retaining strip attached by a weakened connection to the said front wall;
said removable article retaining strip, serving to prevent the passage of articles through the said first dispensing opening;
said removable article retaining strip being tearable from the container to open said first dispensing opening to permit the removal of articles from said container through said first access passage.

8. A cardboard container as claimed in claim 2 further comprising;
two removable article retaining strips;
a first of the said removable article retaining strips being attached by a weakened connection to the said front wall and the said side walls adjacent the said front wall;
a second of said removable article retaining strips being attached by a weakened connection to the said back wall and the said side walls adjacent the said back wall;
said first and second article retaining strip serving to prevent the passage of articles through said first and second dispensing openings respectively;
said first and second removable article retaining strip being tearable from the container container to open the first and second dispensing openings respectively to permit the removal of articles from the container through the first or second dispensing openings.

* * * * *